US007290463B2

(12) United States Patent
Taylor

(10) Patent No.: US 7,290,463 B2
(45) **Date of Patent: *Nov. 6, 2007**

(54) BOTTLE STOP REMOVER

(75) Inventor: Mark Kahn Taylor, Atlanta, GA (US)

(73) Assignee: Wining Taylors, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/651,694

(22) Filed: Jan. 10, 2007

(65) Prior Publication Data

US 2007/0107556 A1 May 17, 2007

Related U.S. Application Data

(63) Continuation of application No. 11/374,404, filed on Mar. 13, 2006, now Pat. No. 7,237,455.

(60) Provisional application No. 60/696,774, filed on Jul. 5, 2005.

(51) Int. Cl.
*B67B 7/06* (2006.01)
*B67B 7/44* (2006.01)

(52) U.S. Cl. ..... 81/3.45; 7/155

(58) Field of Classification Search ..... 81/3.45; 7/155; 215/299

See application file for complete search history.

(56) References Cited

U.S. PATENT DOCUMENTS

| | | | | | |
|---|---|---|---|---|---|
| 73,435 | A | | 1/1868 | Clapp | |
| 164,931 | A | | 6/1875 | Pago | |
| 196,761 | A | * | 11/1877 | Oak | 81/3.08 |
| 1,155,193 | A | | 9/1915 | Balthazar | |
| 1,294,367 | A | | 2/1919 | Shipley | |
| 1,548,519 | A | * | 8/1925 | Flint | 81/3.09 |
| 1,657,728 | A | * | 1/1928 | Untiedt | 7/155 |
| 2,093,541 | A | | 9/1937 | Bohler | |
| 4,727,779 | A | | 3/1988 | Lee | |
| 4,838,128 | A | | 6/1989 | Tischler | |
| 5,010,790 | A | | 4/1991 | Yen | |

(Continued)

FOREIGN PATENT DOCUMENTS

| | | |
|---|---|---|
| CH | 100441 | 12/1921 |

(Continued)

OTHER PUBLICATIONS

International Search Report/Written Opinion—PCT/US2006/023067, Jan. 11, 2007, Taylor, Mark Kahn.

*Primary Examiner*—David B Thomas
(74) *Attorney, Agent, or Firm*—Kilpatrick Stockton LLP

(57) ABSTRACT

The present invention relates to devices and methods for removing a stop from a bottle. In certain embodiments of the present invention, a stabilizer is provided to prevent the stop from being pushed into the bottle and insert members are provided for removing the stop without the outside of the stop adhering to the inner wall of the bottle. Such embodiments allow, among other things, removal of the stop from the bottle without destruction or partial destruction of the stop, as is sometimes the case with conventional corkscrews, yet without the risk of pushing the stop into the bottle as is sometimes the case with non-corkscrew bottle stop removers.

27 Claims, 11 Drawing Sheets

U.S. PATENT DOCUMENTS

| | | | | |
|---|---|---|---|---|
| 5,031,486 | A | 7/1991 | Rydgren | |
| 5,086,675 | A * | 2/1992 | Leung et al. | 81/3.29 |
| 6,179,140 | B1 * | 1/2001 | Gardner | 215/299 |
| 6,510,957 | B2 * | 1/2003 | Gilley et al. | 215/299 |
| 6,763,961 | B2 * | 7/2004 | Gardner et al. | 215/299 |
| 2004/0232102 | A1 * | 11/2004 | Gardner et al. | 215/299 |

FOREIGN PATENT DOCUMENTS

| | | |
|---|---|---|
| DE | 333808 | 3/1921 |

* cited by examiner

BOTTLE STOP REMOVER

CROSS REFERENCE TO RELATED APPLICATIONS

This application is a continuation of U.S. application Ser. No. 11/374,404 filed Mar. 13, 2006, now U.S. Pat. No. 7,237,455 which claims the benefit of U.S. Provisional application Ser. No. 60/696,774 filed Jul. 5, 2005, the contents of which are incorporated herein by reference.

FIELD OF INVENTION

This invention relates generally to devices and methods for removing a stop from a bottle.

BACKGROUND OF THE INVENTION

Some bottles, such as wine bottles, have a stop or cork like structure to retain the bottle's contents inside the bottle. In bottles with a stop, the stop is generally positioned with a friction or interference fit between the inner walls of the bottle opening to block the opening and prevent the contents from spilling, evaporating, spoiling or becoming contaminated. Often a stop, particularly a cork, cannot be easily removed from the bottle without a tool.

One tool used to remove stops from bottles is a corkscrew with a handle or lever. To remove the stop, the corkscrew is rotated into the stop and the handle is pulled or the lever is used to draw the corkscrew out of the bottle along with the stop. Using a corkscrew on older stops and corks, however, may result in the stop or cork being severed, damaged, or the middle of the stop or cork being pulled out of the bottle and the outer part of the stop or cork adhering to the inner wall of the bottle opening. Cork bits in the contents and other effects of such stop damage can be undesirable.

Another device used to remove stops or corks from bottles is a device commonly referred to as an "ah-so." The ah-so has two elements, one typically longer than the other, connected to a handle. Using the handle, the longer element is inserted between the stop and bottle opening inner wall. As the shorter element is then similarly inserted, the handle is rocked and a downward force is applied, first on one element and then on the other, until both of the elements are substantially along the length of the stop. The elements are then twisted and pulled upward using the handle and the stop is removed by and with the elements. Conventional "ah-so" devices, however, may sometimes push the stop or cork, particularly older or fragile corks, into the bottle when the elements are being inserted.

Another device used to remove stops from bottles is a hollow needle that is punched through the stop and air is inserted through the hollow needle. The increasing air pressure in the bottle pushes the stop out of the bottle opening. The stop, however, may be pushed into the bottle in the effort to punch the needle through the stop. Additionally, some find that the liquid contents may be adversely affected by the increased pressure used to remove the cork.

Therefore, a need exists for a device for removing bottle stops that is less likely to, among other things, sever or damage the stop, leave the outer part of the stop adhering to the side of the bottle opening, or push the stop into the bottle.

SUMMARY OF THE INVENTION

The present invention includes new devices and methods for removing stops from bottles. Such devices and methods allow removal of the entire stop, even if the stop is old and fragile, and with little risk that the stop might be pushed into the bottle. Various aspects and embodiments of the present invention provide a stabilizer for gaining purchase or gaining grip within the stop, together with an integrated or connected element that is preferably greater in at least one dimension than the inner diameter of the bottle opening for preventing the stop from being pushed into the bottle. Insert members may also be provided and may be inserted between the stop and the inner wall of the bottle. In some embodiments of the present invention, a handle may be connected directly to the insert members and/or connected detachably to the stabilizer for applying a force to insert the stabilizer and/or to insert the insert members and/or to extract the stop.

In particular embodiments of the invention, the stabilizer may prevent the stop from being pushed into the bottle when the insert members are inserted. The insert members may extract the stop without leaving the outside of the stop remaining on the inner wall of the bottle opening.

In certain embodiments of the present invention, a portion of the stabilizer is helically shaped, similar to a corkscrew, and may be essentially round and/or oval in cross section. In particularly preferred embodiments, the stabilizer is not used to extract the stop. Instead, the stabilizer prevents the stop from being pushed into the bottle. The stabilizer cross element may be an elongated structure with a length longer than the inner diameter of the bottle opening in order to prevent the stop from being pushed into the bottle by the insert members. In preferred embodiments of the present invention, the cross element may rest against the top of the bottle and does not interfere with the insert members being inserted between the stop and inner wall of the bottle opening. Furthermore, the cross element may be smaller than the handle of a conventional corkscrew.

A particular method of the present invention for removing a stop from a bottle includes providing a stabilizer with a first portion for gaining purchase on a stop in a bottle and a second portion with at least one dimension greater than the inner diameter of the bottle opening. A separate device such as a prong may also be provided having a first portion that includes insert members for inserting between the stop and the inner wall of the bottle opening and a second portion with a handle to apply a force to insert the insert members and/or to extract the stop from the bottle. The stabilizer may be inserted into the stop, with a first portion gaining purchase and the prong insert members may then be inserted between the stop and the bottle inner wall. The stabilizer is preferably inserted until the second portion rests against the top of the bottle opening. The stabilizer preferably stabilizes the stop and prevents the stop from being pushed into the bottle when the insert members are inserted. The stop may then be removed by using the prong handle to retract the insert members, stabilizer, and the stop from the bottle opening.

An advantage of certain aspects and embodiments of the present invention is to provide a bottle stop remover that does not push the stop into the bottle.

A further advantage of certain aspects and embodiments of the present invention is to provide a bottle stop remover that removes the whole stop and does not leave part of the cork adhering to the bottle opening inner wall.

A still further advantage of certain aspects and embodiments of the present invention is to provide devices and methods for removing a bottle stop without causing the stop to be severed or damaged in a way that adversely affects the liquid contained in the bottle.

DETAILED DESCRIPTION OF THE INVENTION

Figure 1:
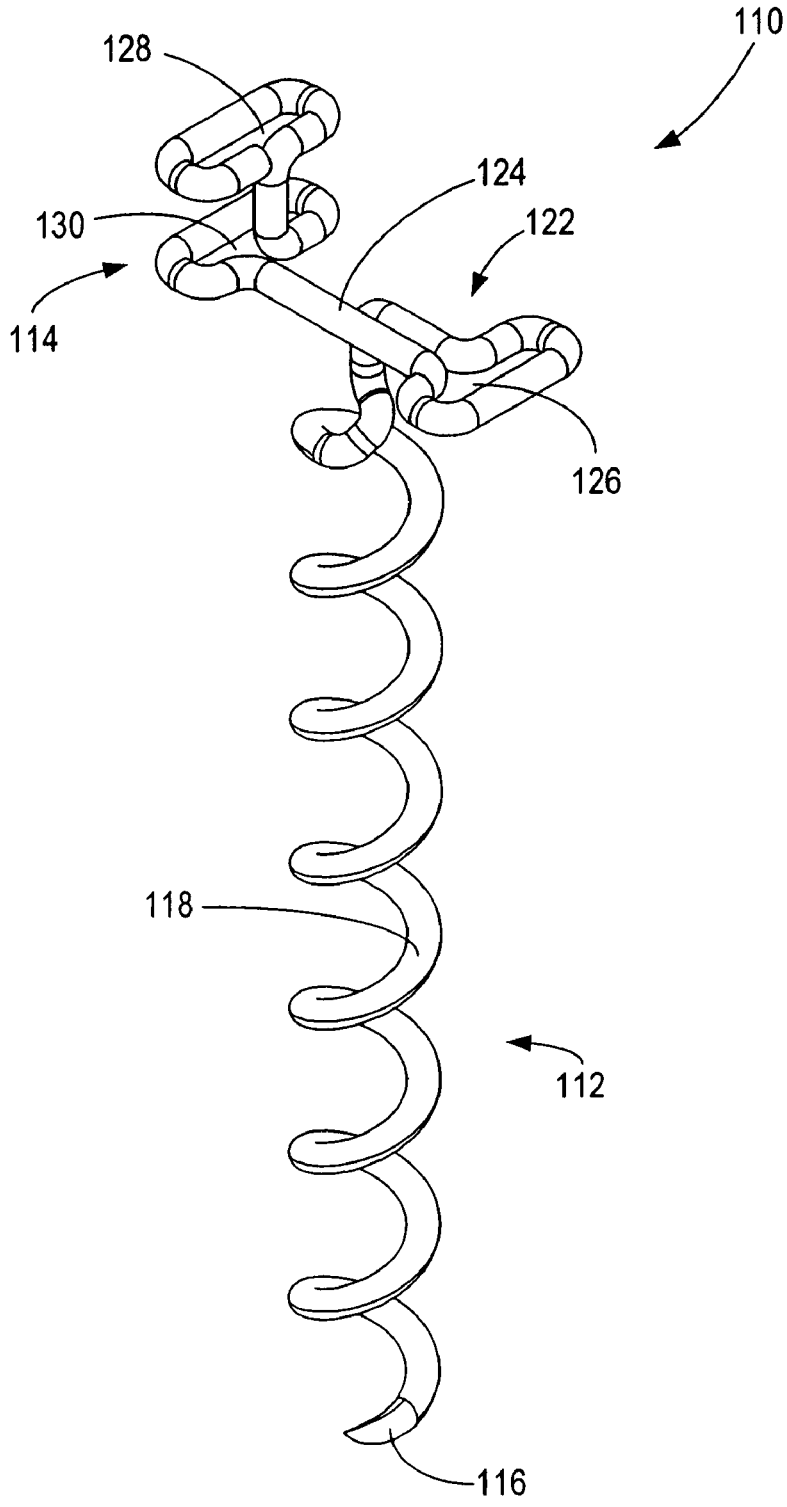
FIG. 1 is a perspective view of a bottle stop remover stabilizer according to one embodiment of the invention.

Referring initially to FIG. 1, illustrated is a stabilizer 110 with a first portion 112 and second portion 114 according to one embodiment of the present invention. The first portion 112 may include a sharp-tipped end 116 for gaining purchase on the stop and a substantially helical shaped body portion 118. The body portion 118 preferably has a helical shape for gaining purchase on a bottle stop. Alternatively, the body portion 118 may have a helical shape with a substantially flat top surface or the body portion 118 may be of any shape or configuration adapted to gain purchase on a stop when it is inserted. The second portion 114 includes a cross element 122 for connecting with insert members from a prong. The cross element 122 may be essentially perpendicular to the stabilizer body portion 118 and include an elongated portion 124 and openings 126, 128, 130 for receiving the prong insert members. Alternatively, cross element may include openings 126, 130 or any number of openings for receiving prong insert members. The cross element 122 preferably features at least one dimension greater than the inner diameter of the bottle opening to, as discussed in more detail below, prevent the stop from being pushed into the bottle. As an example of the greater dimension, the cross element 122 may be longer than that dimension.

Figure 2:
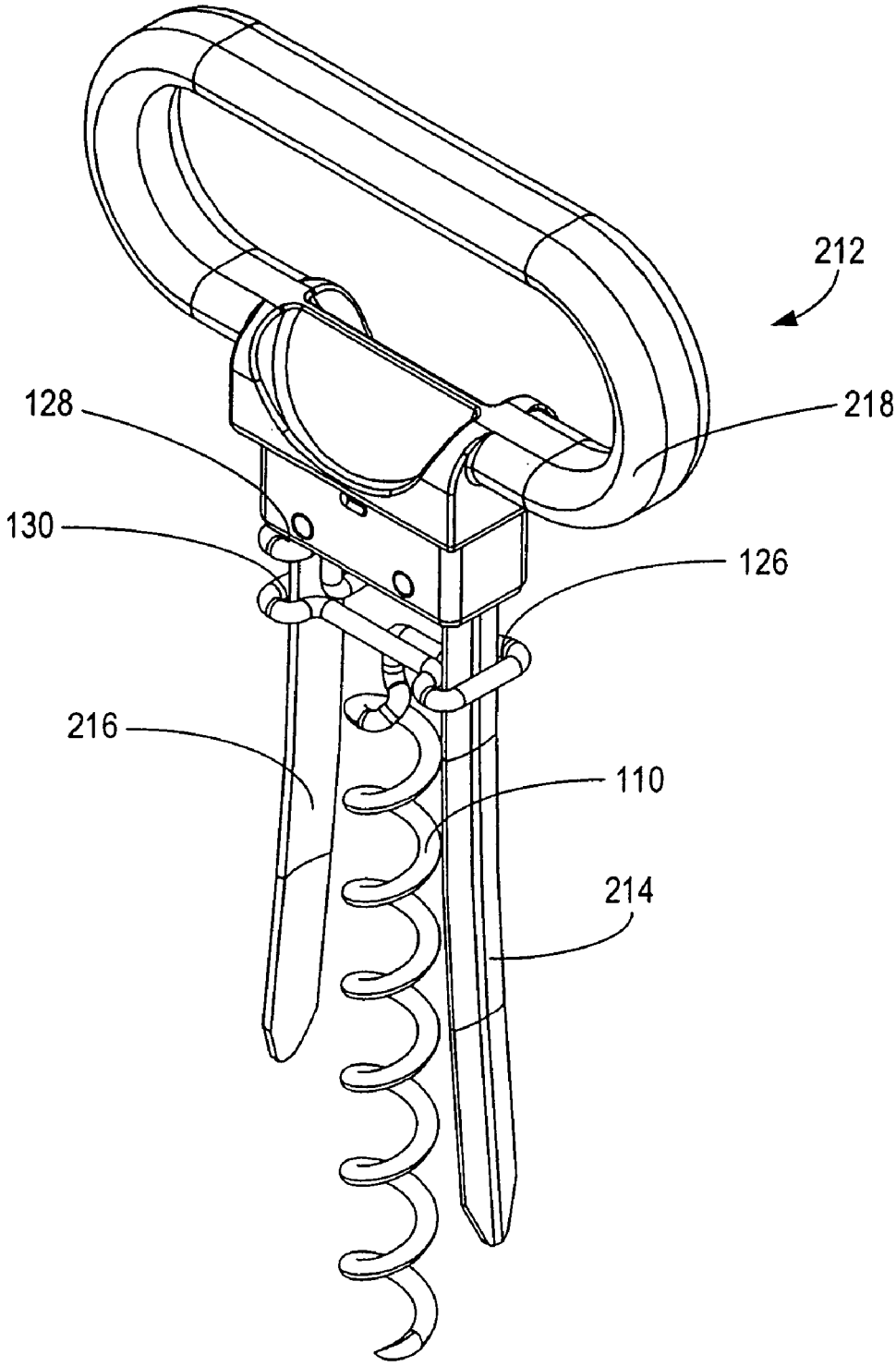
FIG. 2 shows, in perspective, the stabilizer of FIG. 1 detachably connected to a prong according to one embodiment of the invention.

FIG. 2 shows the stabilizer 110 of FIG. 1 detachably connected to a prong 212. The prong 212 preferably includes insert members 214, 216 that may be inserted into the cross element openings 126, 128, 130 of the stabilizer 110. Alternatively, insert members 214, 216 may be inserted into openings 126, 130, for example when the cross element 124 includes only openings 126, 130, or otherwise. The prong 212 may also include a handle 218 connected to the insert members 214, 216. The handle 218 may be used to rotate the stabilizer 110 into and thus gain a purchase on a bottle stop, as well as to insert the insert members 214, 216 between a stop and a bottle's inner wall.

Figure 3:
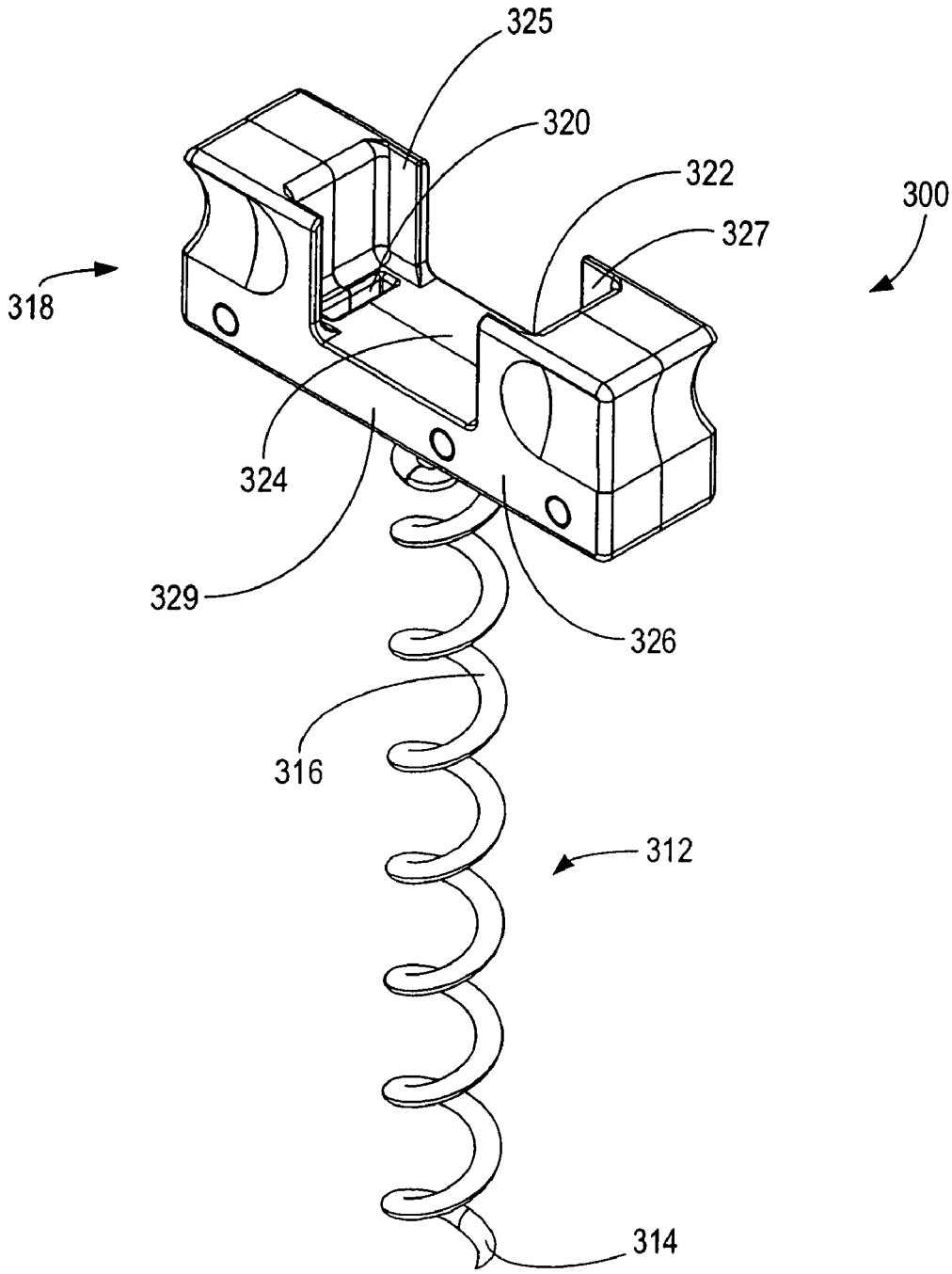
FIG. 3 is a perspective view of a bottle stop remover stabilizer embodying a particular cross element according to another embodiment of the invention.

FIG. 3 shows an alternative embodiment of a stabilizer 300 with a first portion 312 having a sharp-tipped end 314 and a substantially helical body portion 316 according to one embodiment of the present invention. The body portion 316 is preferably connected to a cross element 318 which may, for example, be made from a plastic, metal, or other material and includes openings 320, 322 to receive the insert members of the prong. The cross element 318 may further include an indented area 324 for receiving a portion of a prong handle. The cross-element 318 is preferably longer in length than the inner diameter of the bottle's opening with the indented area 324 having a length such that cross-element 318 does not interfere with the insertion of insert members between the stop and inner wall of the bottle opening.

Figure 4:
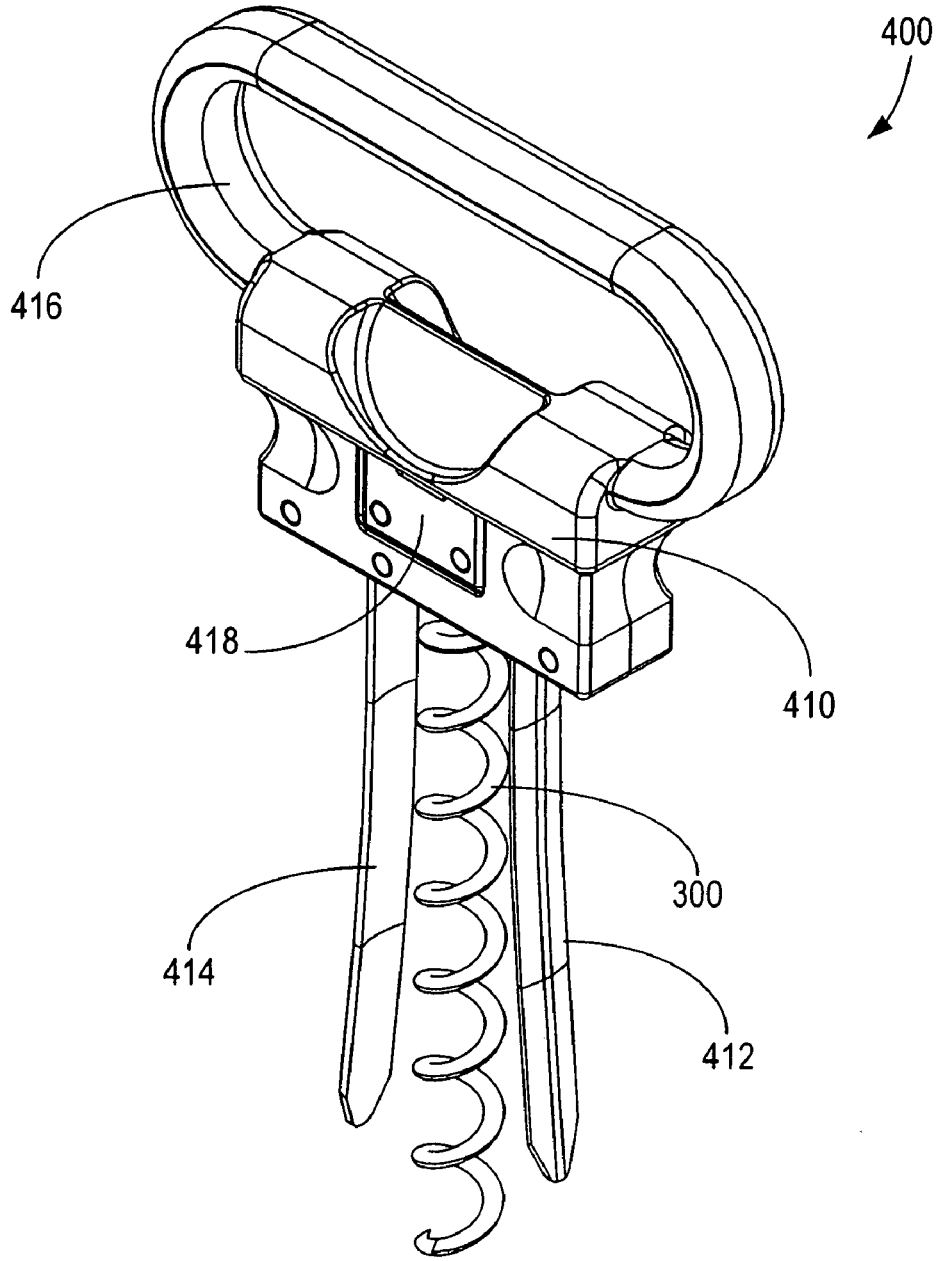
FIG. 4 is a perspective view of the bottle stop remover stabilizer shown in FIG. 3 connected to a prong according to another embodiment of the invention.

FIG. 4 shows a bottle stop remover 400 according to one embodiment of the present invention including the stabilizer 300 of FIG. 3 detachably connected to a prong 410 having a handle 416 with prong insert members 412, 414 inserted through stabilizer cross-element slots 320, 322. The handle 416 includes a handle lower portion 418 that may preferably be located, and in some instances fitted, in the cross-element indented area 324 of the cross element 318 and may be, for example, initially retained in the indented area 324 by side members 325, 327 in the upper portion of the stabilizer cross element 318. The insert members 412, 414 are preferably inserted in the openings 320, 322 of the cross element 318 in FIG. 3. The handle 416 may preferably be used to rotate and insert the stabilizer 300 into a stop, detach the insert members 412, 414 from the stabilizer 300 and insert the prong insert members 412, 414 between a stop and the inner wall of a bottle opening. Finally, the handle 416 may be used to remove the stabilizer 300, insert members 412, 414, and stop from the bottle opening.

Figure 5:
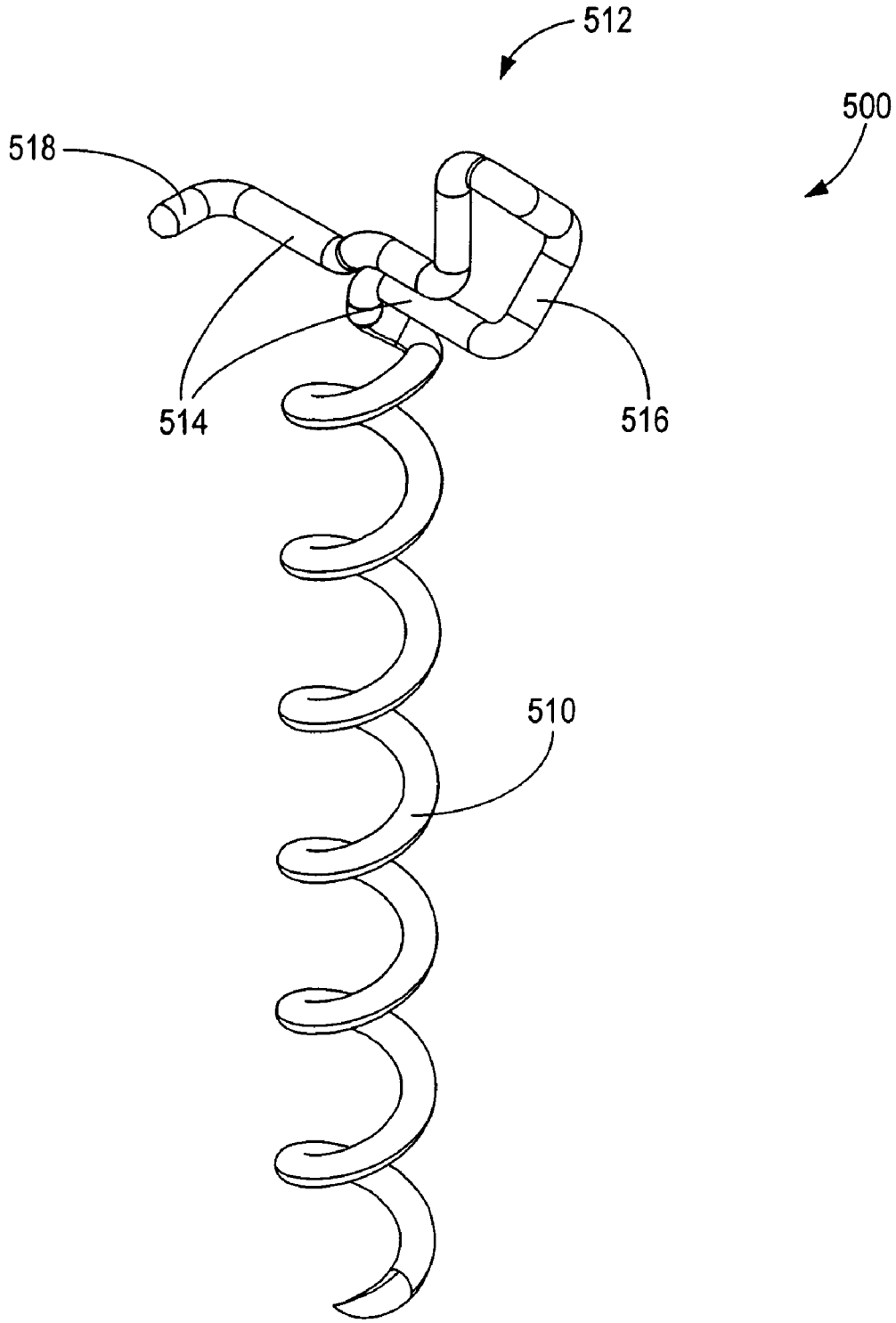
FIG. 5 is a perspective view of a bottle stop remover stabilizer with a cross element adapted to be connected to a prong according to another embodiment of the invention.

FIG. 5 shows another alternative embodiment of a stabilizer 500 according to the present invention, this embodiment having a first helical shaped portion 510 and a second cross element portion 512. The cross element 512 includes a body portion 514 that is preferably greater in at least one dimension than the inner diameter of the bottle opening. The cross element 512 also includes first 516 and second 518 ends that may be attached to insert members of the prong by any method or structure or otherwise.

Figure 6:
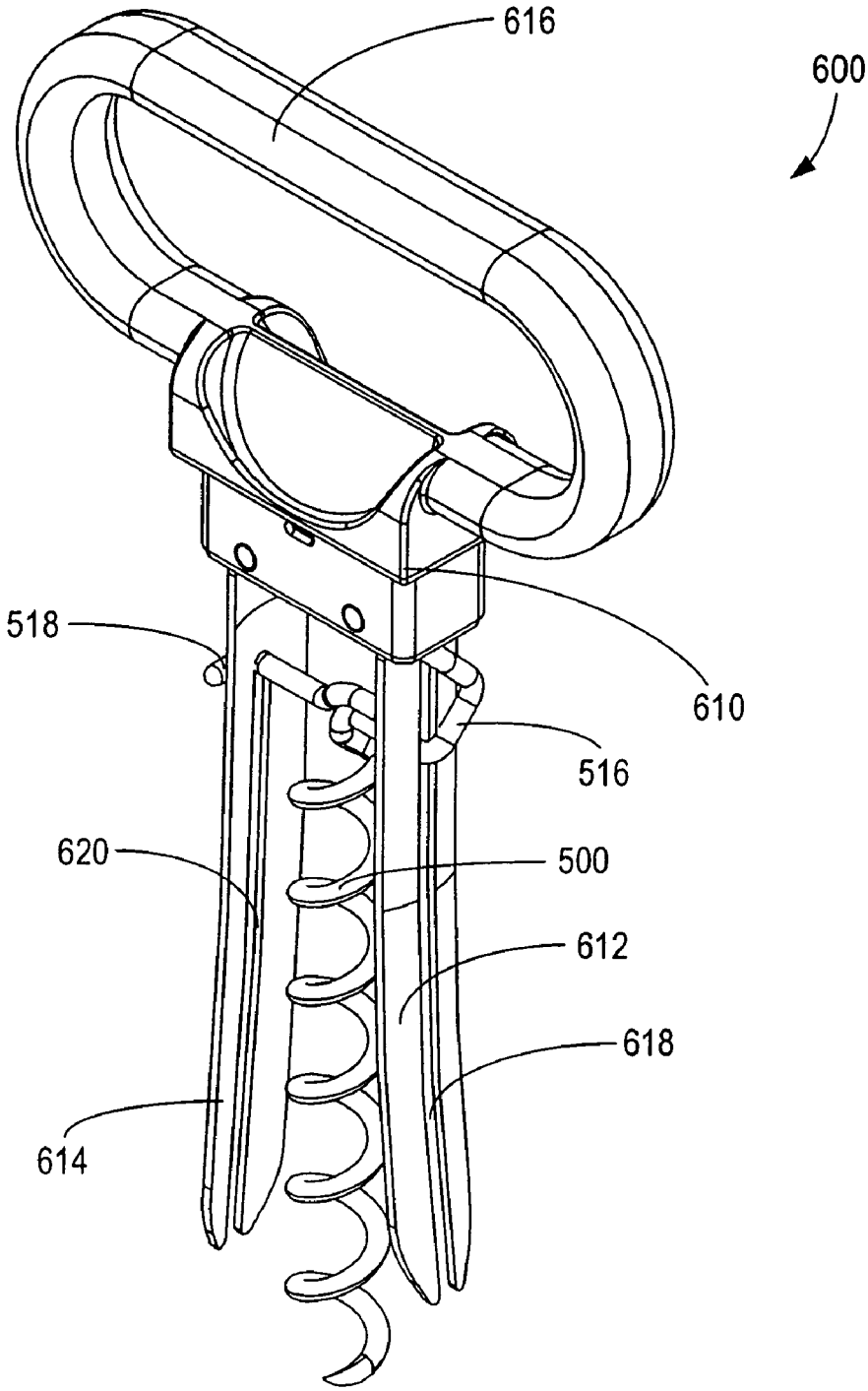
FIG. 6 is a perspective view of the bottle stop remover stabilizer shown in FIG. 5 connected to a prong through openings in the prong insert members.

FIG. 6 shows a bottle stop remover 600, which uses the stabilizer 500 of FIG. 5 detachably connected to a prong 610 by prong insert members 612, 614. The insert members 612, 614 have openings 618, 620 along the length of the insert members 612, 614. The openings 618, 620 allow the insert members 612, 614 to be detachably connected to the stabilizer 500 at the cross element ends 516, 518 by sliding the insert member openings 618, 620 along the cross element ends 516, 518. In some embodiments of the present invention, the openings 618, 620 may be slotted. The ends 516, 518 are configured to prevent the insert members 612, 614 from becoming accidentally detached from the stabilizer 500 when the stabilizer 500 and insert members 612, 614 are connected. A prong handle 616 may preferably be used to rotate and insert the stabilizer 500 into a stop, detach the prong insert members 612, 614 from the stabilizer 500, insert the prong insert members 612, 614 between a stop and the inner wall of a bottle opening, and remove the stabilizer 500, prong insert members 612, 614, and stop from the bottle opening.

Figure 7:
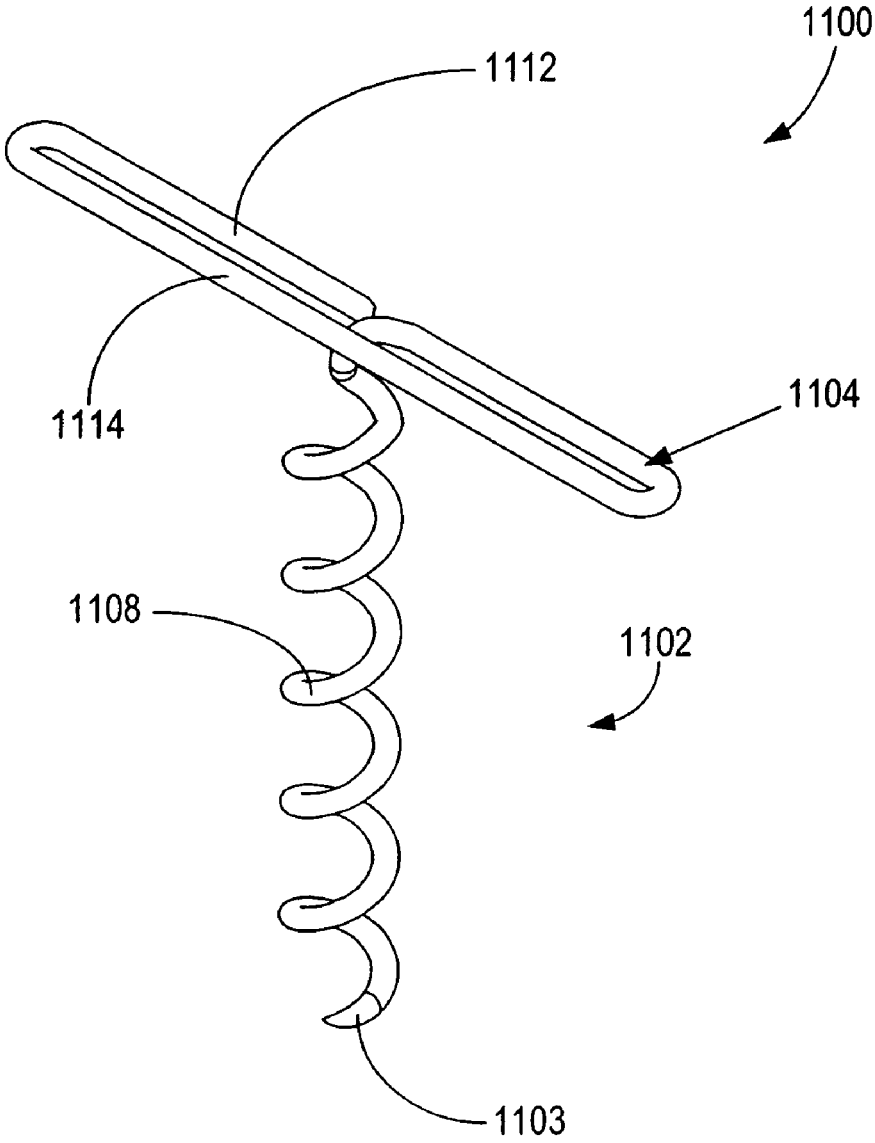
FIG. 7 is a perspective view of a bottle stop remover stabilizer with an elongated cross element according to another embodiment of the invention.

FIG. 7 shows another alternative embodiment of a stabilizer 1100 according to one embodiment of the present invention. The stabilizer 1100 may include a first portion 1102 and an integrated, connected, or otherwise second portion 1104. The first portion 1102 may include a sharp-tipped end 1103 for insertion into the stop and a substantially helical shaped body portion 1108. The body portion 1108 preferably has a helical shape for gaining purchase of a bottle stop. Alternatively, the body portion 1108 may be of any shape adapted to gain purchase of a stop or the helical body portion may have flattened top and/or bottom cross section. The second portion 1104 includes a cross element 1112 for inserting the stabilizer 1100 into a stop preferably until, for example, the second portion 1104 rests on the top of the bottle opening. The cross element 1112 may be essentially perpendicular to the stabilizer body portion 1108 and include an elongated portion 1114. The cross element 1112 is preferably longer than the diameter of the bottle opening to facilitate inserting the stabilizer 1100 into the stop and then, after gaining purchase on the stop, to prevent the stop from being pushed into the bottle.

The stabilizer 1100 may be rotated into the stop and gain a purchase on the stop. The stabilizer 1100 may be manually rotated into the stop using the fingers or any desired tool or device. Alternatively, a handle may be detachably, or otherwise, connected to the stabilizer 1100 for inserting the stabilizer into the cork. The stop and stabilizer 1100 may then be removed using a separate device.

Figure 8:
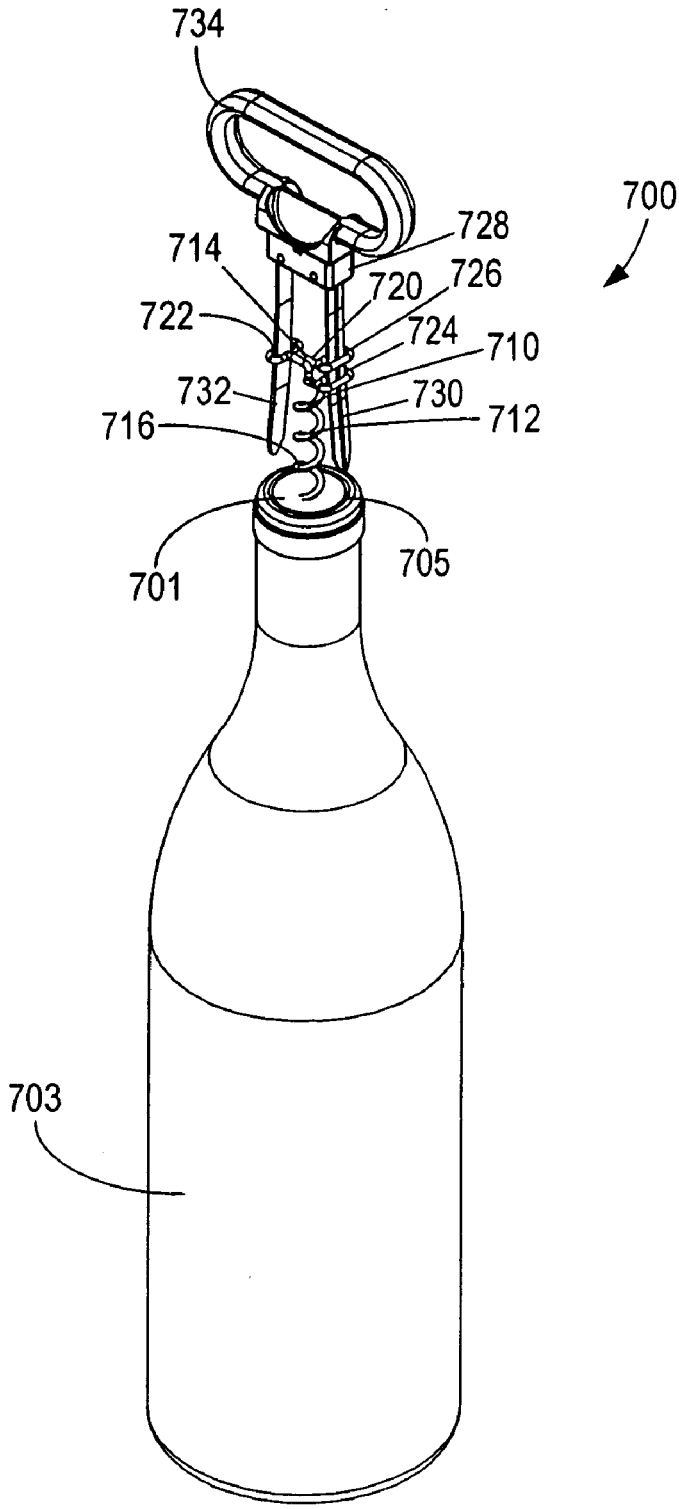
FIG. 8 shows the bottle stop remover stabilizer of FIGS. 1 and 2 being inserted into the stop of a bottle using the prong handle and insert members of FIG. 2 according to one embodiment of the invention.

FIGS. 8-11 are a sequence of illustrations that show a bottle stop remover 700 according to one embodiment of the present invention (FIGS. 1 and 2) removing a stop 701 from a bottle 703. As shown in FIG. 8, a stabilizer 710 is provided with a first helical shaped portion 712 and a second cross-element portion 714. The helically shaped portion 712 may include a sharp-tipped end (not shown) and a body portion 716 for gaining purchase on the stop 701. Alternatively, the stabilizer 710 may be of any configuration to gain purchase on the stop 701. The cross element portion 714 includes an elongated portion 720 that is longer than the inner diameter of the bottle opening 705. The elongated portion 720 includes end openings 722, 724, 726 for detachably connecting to a prong 728.

Figure 9:
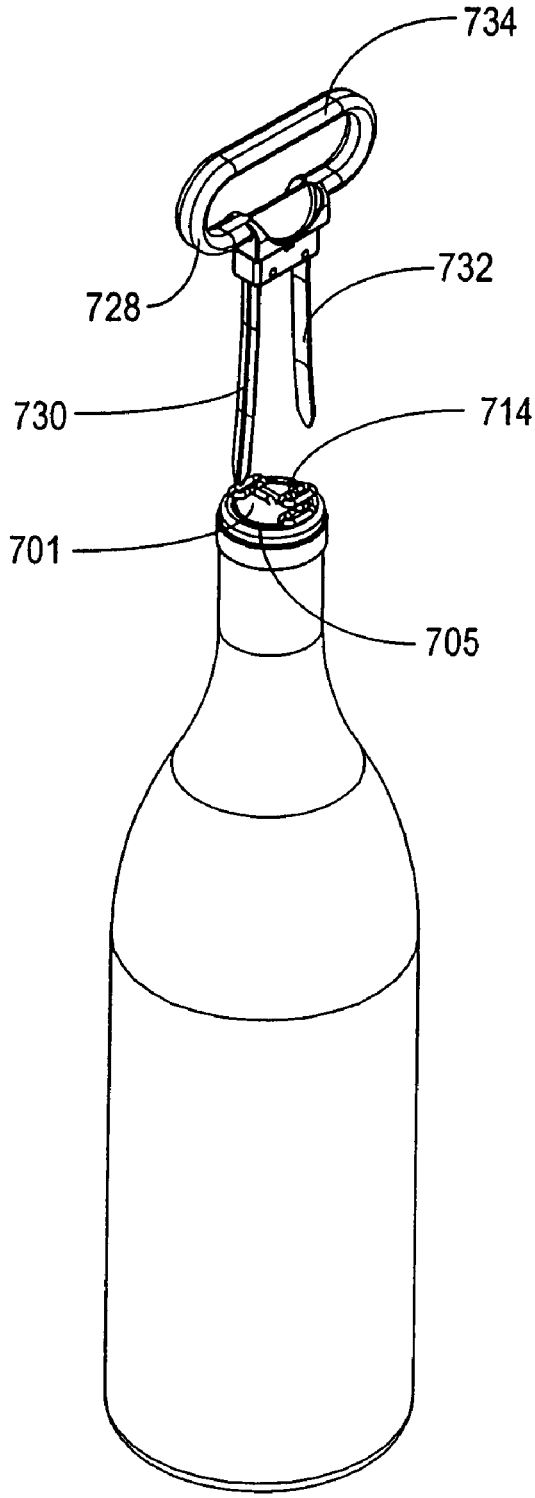
FIG. 9 shows the prong insert members and handle of FIG. 8 being disengaged from the stabilizer of FIG. 8.

The prong 728 is provided having insert members 730, 732 connected to a handle 734. In some embodiments of the present invention, one insert member 732 is preferably longer than the other insert member 730. As illustrated in FIG. 8, the insert members 730, 732 are inserted in the stabilizer end openings 722, 724, 726 and the stabilizer end is located approximately in the center of the stop 701. The handle 734 may then be used to rotate the prong and thus the stabilizer 710 (here as an example in the clockwise direction) and with a slight force downward with respect to the stop 701 to gain purchase in the stop. The stabilizer 710 is inserted and rotated into the stop until the cross element 714 is at the top of the bottle opening 705, and preferably against the top of the bottle opening 705 as shown in FIG. 9. Alternatively, the stabilizer 710 may be inserted and rotated into the stop manually. The prong 728 is then removed from the stabilizer end openings 722, 724, 726 by pulling upward on the handle 734.

Figure 10:
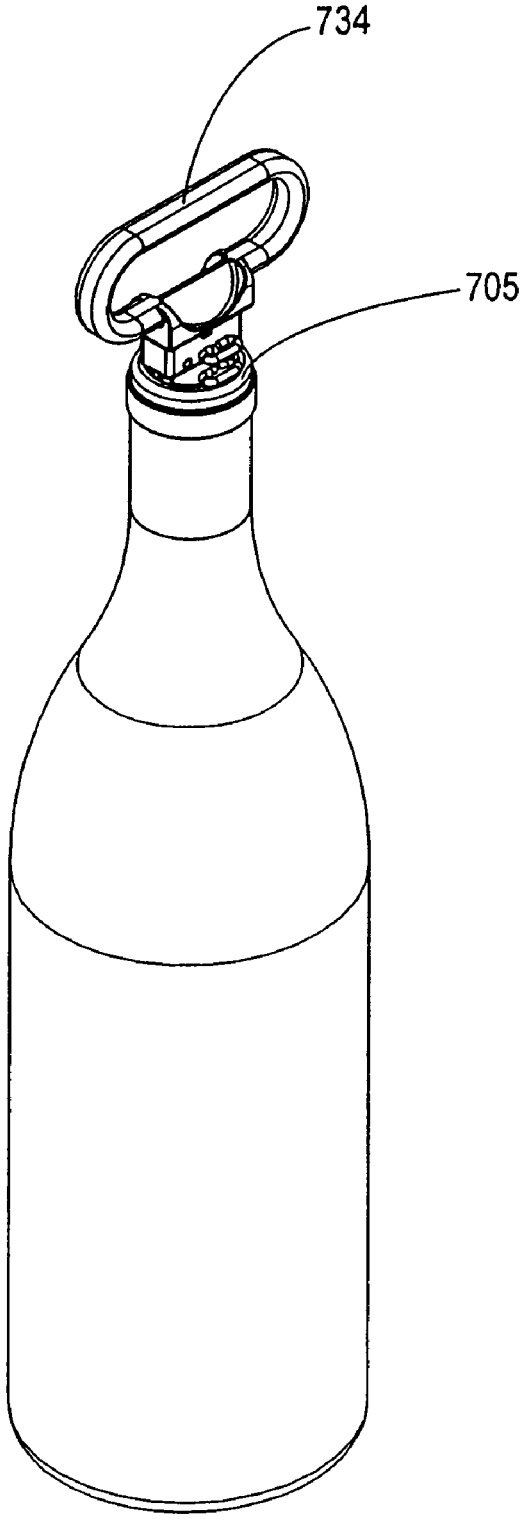
FIG. 10 shows the prong insert members of FIG. 8 inserted between the stop and inner wall of the bottle opening.

The handle 734 and prong 728 are then rotated, preferably 90 degrees with respect to cross element 714, but may be rotated as desired to allow the insert members 730, 732 to be inserted between the stop 701 and the inner wall of the stop opening 705. Using the handle, the insert members 730, 732 are inserted between the stop 701 and the inner wall of the bottle opening 705 by partially inserting one insert member 732, preferably the longer insert member, pressing down and rocking the insert member 732, as needed, to partially insert it, and then inserting the other insert member 730 and pressing down slightly. Using the handle 734, the insert members 730, 732 may be alternately pressed down, as needed, until the bottom of the handle is located at the top of the bottle opening 705 and the insert members 730, 732 extend along the stop 701, as illustrated in FIG. 10.

In one embodiment, the insert members 730, 732 are preferably attached to the stabilizer 710. The stabilizer 710 is inserted into the stop 701. The insert members 730, 732 are preferably inserted between the stop 701 and the inner wall of the bottle opening 705 without detaching the insert members 730, 732 from the stabilizer 710 and/or rotating the insert members 730, 732.

Figure 11:
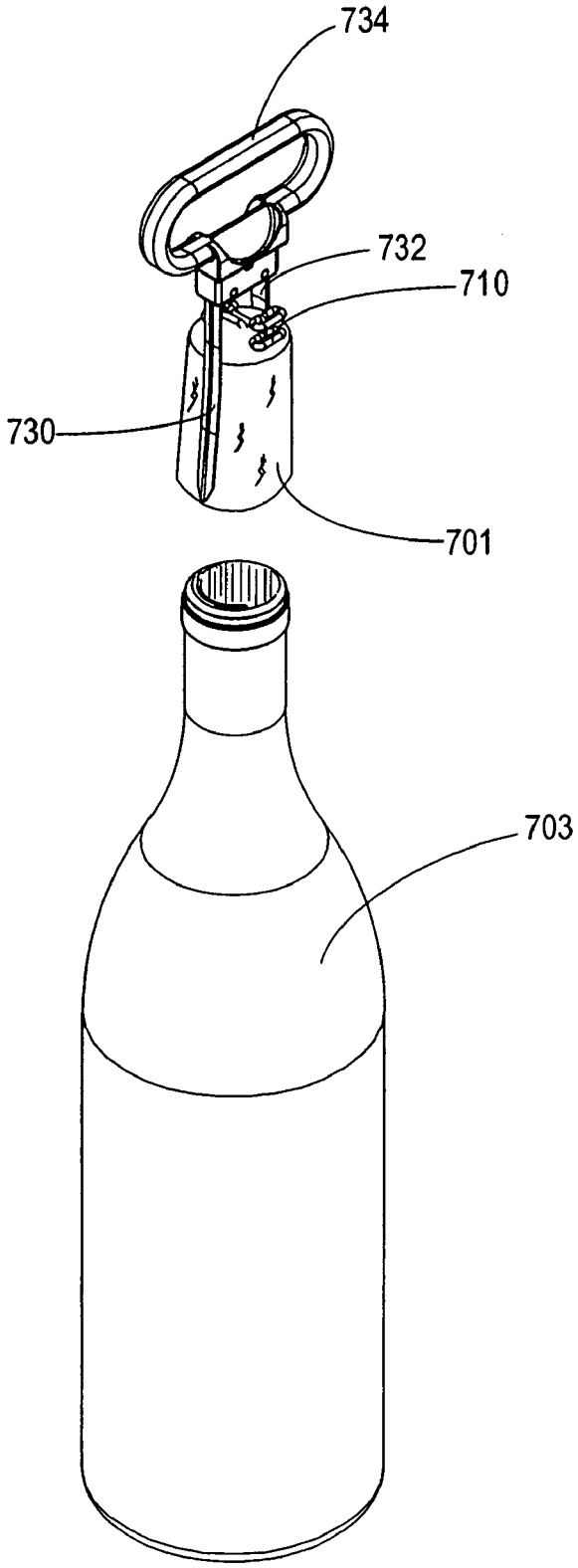
FIG. 11 shows the stop being removed from the bottle with the prong insert members of FIG. 8.

As illustrated in FIG. 11, the handle 734 may be twisted slightly and pulled upward, thereby removing the insert members 730, 732, stabilizer 710, and stop 701 from the bottle 703. The stop 701, removed from the bottle 703 with the insert members 730, 732, is separated from the stabilizer 710 for reuse by preferably holding the stop to prevent the stop from rotating and rotating the stabilizer 710 counter-clockwise relative to the top of the stop.

The following is an example of a particularly preferred embodiment of the bottle stop remover and specifically an embodiment for removing a cork from most wine bottles. The stop remover illustrated in FIGS. 3 and 4 includes a stabilizer 300 having a body portion 316 and a cross element 318. The body portion 316 is made from spring or annealed steel, has a helical shape, a sharp-tipped point 314, and is approximately 2.35 inches in length. At least a part of the cross element (not shown) is also made from steel and connected directly to the body portion 316. A cross element body 326 made from plastic or metal encloses the cross element portion that is connected directly to the body portion 316 and they together form the cross element 318. An indented area 324 is included within the cross element 318 to permit insert members 412, 414 to be inserted between the stop and inner wall of a bottle opening while the stabilizer is preferably gaining purchase on the stop. In addition, the indented area 324 may receive and retain a prong handle. Below the indented area 324, the cross element 318 has a top to bottom dimension 329 that is at least equal to the difference in length between insert member 412 and insert member 414. The cross-element 318 also includes openings 320, 322 through which the insert members 412, 414 are located. The openings 320, 322 are approximately 0.1 inches wide, 0.25 inches long, and 0.7 inches apart.

The preferred bottle stop remover also includes a handle 416 and insert members 412, 414. The handle 416 is made from metal while the insert members 412, 414 are made from one piece of spring or annealed steel that is shaped in an essentially squared U-shape and connected to the handle 416. One prong 412 is longer than the other prong 414. Prong 412 has a length of 2.3 inches while prong 414 has a length of 2.45 inches.

Unless otherwise stated, terms used herein such as "top," "bottom," "upper," "lower," "left," "right," "front," "back," and the like are used only for convenience of description and are not intended to limit the invention to any particular orientation.

What is claimed is:

1. A stabilizer for preventing a stop from being pushed into an inner cavity of a bottle during the removal of the stop, the bottle having a top and an opening with an inner wall, the stop being located in the opening, the stabilizer comprising:

a first portion for gaining purchase on said stop; and a second portion having at least one dimension greater than the bottle opening, wherein the stabilizer second portion is adapted to rest against the top of the bottle and not obstruct access to the stop by at least one insert member after the stabilizer first portion gains purchase on the stop.

2. The stabilizer of claim 1, wherein the stabilizer second portion is adapted to be rotated by a person's hand.

3. The stabilizer of claim 1, wherein the stabilizer second portion is adapted to be rotated by at least one insert member.

4. The stabilizer of claim 1, wherein the stabilizer second portion comprises a detachable handle.

5. The stabilizer of claim 4, wherein the stabilizer first portion is adapted to gain purchase on the stop by use of a detachable handle.

6. The stabilizer of claim 1, wherein the stabilizer second portion is a cross element.

7. The stabilizer of claim 1, wherein the stabilizer first portion comprises a sharp-tipped end.

8. The stabilizer of claim 1, wherein the stabilizer first portion is essentially helically shaped.

9. The stabilizer of claim 1, wherein the stabilizer second portion is adapted to prevent the stop from being pushed into the inner cavity of a bottle; and wherein the stabilizer is not used to remove the stop from the bottle.

10. The stabilizer of claim 1, wherein the stabilizer second portion is adapted to permit at least one insert member to be inserted between the stop and the inner wall of the bottle opening after the stabilizer gains purchase on the stop.

11. The stabilizer of claim 1, wherein the stabilizer second portion comprises at least one dimension sized to permit access to the stop by at least one insert member after the stabilizer first portion gains purchase on the stop.

12. A method of preventing a stop from being pushed into an inner cavity of a bottle during the removal of the stop, the bottle having an opening with an inner wall and the stop being located in the opening, the method comprising:

providing a stabilizer having a first portion for gaining purchase on said stop and a second portion having at least one dimension greater than the bottle opening;

inserting the stabilizer into the stop without obstructing access to the stop by at least one insert member; and preventing said stop from being pushed into the bottle.

13. The method of claim 12, further comprising:

providing a stabilizer second portion having at least one dimension sized to permit access to the stop by at least one insert member after the stabilizer first portion gains purchase on the stop.

14. The method of claim 12, further comprising:

providing a stabilizer handle;

detachably connecting said stabilizer handle to said stabilizer second portion;

inserting the stabilizer into the stop using the stabilizer handle; and detaching said stabilizer handle from said stabilizer second portion.

15. The method of claim 12, further comprising:

providing a stabilizer first portion having a sharp-tipped end.

16. The method of claim 12, further comprising:

providing a stabilizer first portion that is essentially helically shaped.

17. The method of claim 12, further comprising:

maintaining the stabilizer in the stop while the stop is removed by another device.

18. A stabilizer for preventing a stop from being pushed into an inner cavity of a bottle during the removal of the stop, the bottle having a top and an opening with an inner wall and the stop being located in the opening, the stabilizer comprising:

a first portion for gaining purchase on said stop;

a second portion having at least one dimension greater than the bottle opening, the second portion being adapted to prevent the stop from being pushed into the inner cavity of the bottle, wherein the stabilizer is not used to remove the stop from the bottle; and wherein the stabilizer second portion is adapted to permit at least one insert member to be inserted between the stop and the inner wall of the bottle opening after the stabilizer gains purchase on the stop.

19. The stabilizer of claim 18, wherein the stabilizer second portion is adapted to be rotated by a person's hand.

20. The stabilizer of claim 18, wherein the stabilizer second portion is a cross element.

21. The stabilizer of claim 18, wherein the stabilizer first portion comprises a sharp-tipped end.

22. The stabilizer of claim 18, wherein the stabilizer first portion is essentially helically shaped.

23. The stabilizer of claim 18, wherein the stabilizer second portion is adapted to rest against the top of the bottle after the stabilizer first portion gains purchase on the stop.

24. The stabilizer of claim 18, wherein the stabilizer second portion is adapted to not obstruct access to the stop by at least one insert member after the stabilizer first portion gains purchase on the stop.

25. The stabilizer of claim 18, wherein the stabilizer second portion comprises a detachable handle.

26. The stabilizer of claim 18, wherein the stabilizer first portion is adapted to gain purchase on the stop by use of a detachable handle.

27. The stabilizer of claim 18, wherein the stabilizer second portion comprises at least one dimension sized to permit access to the stop by at least one insert member after the stabilizer first portion gains purchase on the stop.

* * * * *